US008011453B2

(12) United States Patent
Lavrut et al.

(10) Patent No.: US 8,011,453 B2
(45) Date of Patent: Sep. 6, 2011

(54) DRILLING SYSTEM AND METHODS OF DRILLING LATERAL BOREHOLES

(75) Inventors: Eric Lavrut, Sagamihara (JP); Charles Woodburn, Clamart Cedex (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/065,308

(22) PCT Filed: Aug. 28, 2006

(86) PCT No.: PCT/EP2006/008420

§ 371 (c)(1),
(2), (4) Date: Sep. 2, 2008

(87) PCT Pub. No.: WO2007/039025

PCT Pub. Date: Apr. 12, 2007

(65) Prior Publication Data

US 2008/0314643 A1 Dec. 25, 2008

(30) Foreign Application Priority Data

Sep. 19, 2005 (EP) ..... 05291952

(51) Int. Cl.
*E21B 7/04* (2006.01)

(52) U.S. Cl. ..... 175/81; 175/80; 175/79; 175/61

(58) Field of Classification Search ..... 175/80, 175/81, 79, 61

See application file for complete search history.

(56) References Cited

U.S. PATENT DOCUMENTS

| | | | | |
|---|---|---|---|---|
| 2,839,270 | A * | 6/1958 | McCune et al. | 175/83 |
| 4,007,797 | A * | 2/1977 | Jeter | 175/26 |
| 4,577,703 | A * | 3/1986 | Cyriacy et al. | 175/79 |
| 4,700,788 | A * | 10/1987 | Langner | 175/61 |
| 5,373,906 | A | 12/1994 | Braddick et al. | |
| 6,138,756 | A | 10/2000 | Dale et al. | |
| 6,220,372 | B1 | 4/2001 | Cherry | |
| 6,260,623 | B1 * | 7/2001 | Schick | 166/313 |
| 6,964,303 | B2 * | 11/2005 | Mazorow et al. | 166/298 |
| 2006/0054354 | A1 * | 3/2006 | Orban | 175/40 |

FOREIGN PATENT DOCUMENTS

| | | |
|---|---|---|
| EP | 0227456 | 7/1987 |
| GB | 2345501 | 7/2000 |

* cited by examiner

*Primary Examiner* — Daniel P Stephenson
*Assistant Examiner* — Yong-Suk Ro
(74) *Attorney, Agent, or Firm* — Jianguang Du

(57) ABSTRACT

A drilling system is presented for use in drilling lateral boreholes from a main borehole. The drilling system generally comprises a drilling machine, a drill string connected to the drilling machine so as to be driveable in an axial direction, and a guide connected to the drilling machine such that when the drill string is driven axially by the drilling machine, it interacts with the guide so as to be directed in a predetermined radial direction. A method of drilling a lateral borehole from a main borehole is also presented, comprising the steps of: positioning the drilling system in the main borehole; anchoring the guide in the borehole; operating the drilling machine to drive the drill string in an axial direction; and deflecting the drill string, by means of the guide, in a radial direction into the wall of the main borehole to drill the lateral borehole.

21 Claims, 7 Drawing Sheets

DRILLING SYSTEM AND METHODS OF DRILLING LATERAL BOREHOLES

TECHNICAL FIELD

This invention relates to drilling systems and in particular to such systems for use in drilling lateral boreholes from a main borehole.

BACKGROUND ART

In the extraction of hydrocarbons such as oil and gas from underground formations, it is common practice to drill a borehole from the surface to the hydrocarbon bearing formation. Such formations often have significant horizontal extent but are of limited vertical extent. Thus, to optimise the amount of hydrocarbon extracted, it is desirable to optimise the path of the borehole through the formation. In recent years, the drilling of non-vertical boreholes (often called 'deviated' or 'horizontal' boreholes) in hydrocarbon formations has been undertaken for this reason. However, in certain cases, only a 'vertical' borehole is available. For example, an old borehole drilled before deviated drilling procedures were developed might pass through a hydrocarbon formation for only a short path. In other cases, the original well may have bypassed formations containing hydrocarbons. One way to improve hydrocarbon recovery in such cases is to drill further, 'lateral' boreholes from the main borehole into the formation(s) of interest.

Using traditional drilling methods, the technique for drilling lateral borehole comprises setting a whipstock in the well at the desired location and using the whipstock to cause a drill bit on a drill string to drill into the sidewall of the borehole to create the lateral borehole. Once the lateral is drilled, the drill string is withdrawn from the borehole and the whipstock must be recovered. If it is desired to drill several laterals, the whipstock must be repositioned and withdrawn each time. Thus the process is slow and expensing, as it requires the presence of a drilling rig or a coiled tubing drilling unit to perform these operations.

WO2004072437 A discloses an electric drilling machine that can be run on wireline cable. The drilling machine carries a kick plate which it orients prior to drilling to force the drill bit in the desired direction to drill the lateral. The mechanism for connecting the kick plate to the drilling machine and for orienting it to drill in the desired direction is relatively complex.

This invention provides a simpler approach by supporting a guide on the drill string and orienting the guide by rotating the drill string with the drilling machine.

DISCLOSURE OF THE INVENTION

One aspect of the invention comprises a drilling system, comprising:

- a drilling machine;
- a drill string connected at one end to the drilling machine so as to be driveable in an axial direction; and
- a guide connected to the drilling machine such that when the drill string is driven axially by the drilling machine, it interacts with the guide so as to be directed in a predetermined radial direction;

wherein the drill string is permanently engaged so as to be slideable in the guide.

The drill string typically carries a drill bit at the end remote from the drilling machine.

The drill string can also be rotatable by the drilling machine. In this case, the drill string can be used to transmit rotation to the guide so as to adjust the predetermined radial direction. Alternatively, the guide can include an integrated rotating device that allows adjustment of the predetermined radial direction.

The guide can be coaxial with the drilling machine or offset. In one embodiment, the guide defines a guide path that is substantially central to the guide at a point nearest the drilling machine and exits from a side part of the guide further away from the drilling machine, the drill string being slideably engaged in the guide path. In another embodiment, the guide path is offset from the centre of the guide at the point nearest the drilling machine. The guide can also include a seat into which the drill bit or a contact ring on the drill string near the drill bit can locate. It is preferred that the seat and the drill bit or contact ring include inter-engaging formations to prevent relative rotation of the guide and drill string when the bit or contact ring are engaged in the seat.

The guide preferably comprises anchors that are operable to secure the guide in place in a borehole. In one embodiment, the anchors are arranged around the guide so as to secure it in an approximately central position in the main borehole. In another embodiment, the anchors are positioned to one side of the guide so as to force it against the wall of the main borehole and secure it in place.

The drilling machine preferably includes anchors operable to engage the borehole and provide a reaction to axial and rotation forces. Such anchors may typically form part of a drilling tractor for moving the drill string in an axial direction. The anchors can be in the form of a piston extending radially from the drilling machine. Such form of anchor can also be used for the guide.

In one embodiment, a telescopic link extends between the drilling machine and the guide.

A control line may also be provided that extends between the drilling machine and the guide.

The drilling system according to the invention is preferably supported by a flexible conveyance means such as a wireline cable or coiled tubing.

The guide can also house one or more sensors for location in the lateral borehole. In one preferred embodiment, one or more strings of sensors a held in the guide.

A second aspect of the invention comprises a method of drilling a lateral borehole from a main borehole, comprising:

- positioning a drilling system as claimed in any preceding claim in the main borehole;
- anchoring the guide in the borehole adjacent the location at which the lateral borehole is to be drilled;
- operating the drilling machine to drive the drill string in an axial direction;
- deflecting the drill string, by means of the guide, in a radial direction into the wall of the main borehole to drill the lateral borehole.

Prior to anchoring the guide, the drill string is preferably rotated with the drilling machine to orient the guide so as to deflect the drill string in the predetermined direction. Alternatively, an integrated rotating device (part of the guide) could also be used to orient the guide It is particularly preferred that, after drilling the lateral borehole, the anchor of the guide is released, the drilling system is moved to a new position in the main borehole and the steps of anchoring, operating and deflecting are repeated to drill a further lateral borehole.

The guide can be supported on the drill string or on a separate support during the step of positioning or moving the drilling system in the main well.

When the guide is carrying sensors for installation in the lateral borehole, the method can further comprise, following drilling of the lateral borehole, withdrawing the drill bit into the guide, positioning the sensors in the guide below the drill bit and advancing the drill string so as to install the sensors in the lateral borehole by means of the drill bit.

The invention therefore provides a particularly convenient system that can be used to drill multiple lateral boreholes from a main borehole. It also provides a solution suitable for sensor installation and coring.

BRIEF DESCRIPTION OF THE DRAWINGS

The invention will now be described in relation to the accompanying drawings, in which.

MODE(S) FOR CARRYING OUT THE INVENTION

Figure 1A:
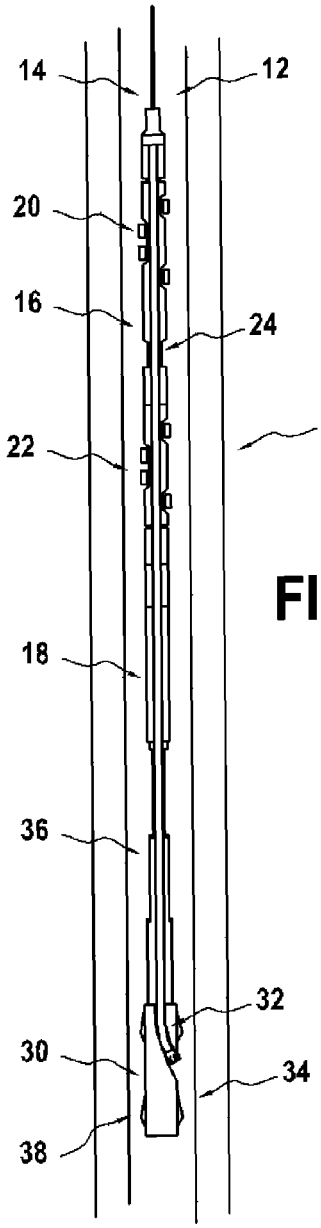
FIGS. 1*a* and 1*b* show a first embodiment of a drilling system according to the invention.
Figure 1B:
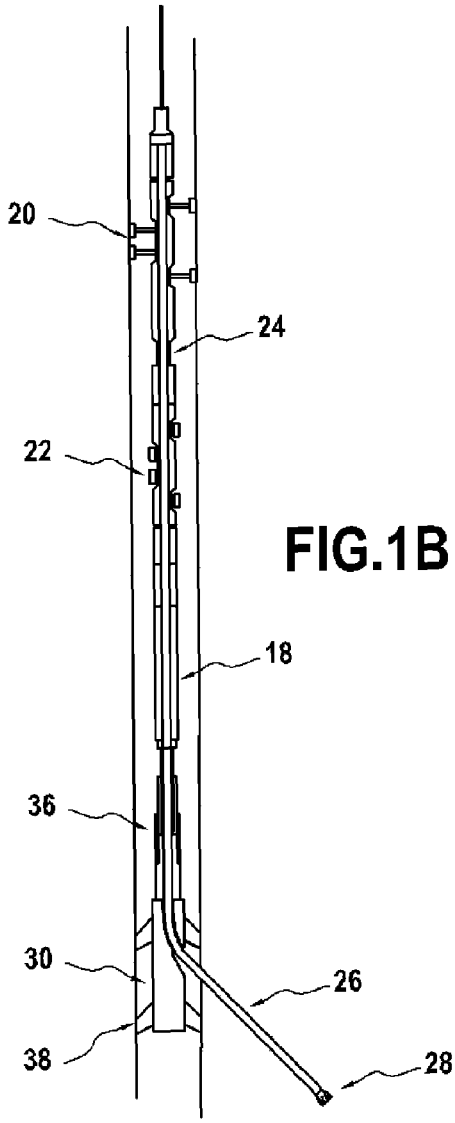

A first embodiment of the invention is shown in FIGS. 1*a* and 1*b*. The drilling system shown therein comprises a drilling machine 10 suspended in a main borehole 12 on a wireline cable 14 that extends to the surface.

The drilling machine 10 comprises a drilling tractor 16 and a drilling motor 18. The drilling tractor 16 is preferably of the type described in WO 2004072437 A and includes pairs of anchors 20, 22 and a drive section 24. By sequentially deploying the anchors 20, 22 and operating the drive section 24 to extend and contract, the drilling tractor 16 can be caused to move along the main borehole 12 and apply an axial driving force to any equipment connected thereto.

The drilling motor 18 is connected to the lower end of drilling tractor 16 and provides a rotary drive relative to the tractor 16. Appropriate sensors are included to establish the rotary position of the motor output in the borehole allowing operation of the motor 18 to achieve any predetermined orientation. Such sensors and the orientation of motors are known in the field of borehole tools.

A flexible drill string 26 is connected at one end to the drilling motor 18 and has a drill bit 28 located at the other end. The function of the drill string 26 is to transmit both axial (weight on bit) and rotary (torque on bit) forces from the drilling machine 10 to the drill bit 28.

The drill string 26 is preferably tubular to allow at flow of drilling fluid to be directed through the drill bit 28 for hole cleaning purposes (either in standard or reversed circulation). Such flow can be provided by a downhole pump and drilled cuttings can be collected in a cuttings basket (not shown) or disposed in the main borehole. The drill string 26 can be a simple pipe or have a more complex construction such as a coaxial string (rotating shaft inside a sliding pipe) and can be made out of a metal alloy such as steel, aluminium, titanium alloy, etc. or a composite material. Another form of drill string applicable is described in GB 2403236 A.

A guide 30 is provided below the drilling machine 10. The drill string extends from the drilling motor 18 and passes through the guide 30 along a deviated guide path 32. The guide is substantially axially aligned with the drilling machine 10 and the drill string 26 enters the guide path 32 close to the centre of the guide. The deviation in the guide path 32 means that it exits laterally, pointing towards the main borehole wall 34. The path 32 is dimensioned to allow the drill string to slide relative to the guide 30. The end of the path 32 is of enlarged diameter (described in more detail below) so as to form a seat into which the drill bit 28 can engage so as to sit within the outer diameter of the guide. At least part of the remainder of the guide path is smaller than the bit diameter so as to prevent the drill bit from being completely withdrawn from the guide.

The guide path is preferably deviated such that the exit is directed perpendicularly to the axis of the main borehole. Thus, sliding movement of the drill string 26 can be altered by 90° due to the guide path without the need for a bent drilling motor.

The guide is connected to the drilling machine 10 by means of a telescopic support 36. Consequently, the drilling machine 10 can support the weight of the guide 30 but cannot push it forward.

A series of anchor arms 38 are mounted on the guide 30. These arms can be moved between a first position in which they lie close to the guide 30 (see FIG. 1*a*) and a second position in which they engage the main borehole wall 34 to anchor the guide in place (see FIG. 1*b*). Thus, the drilling machine 10 can push the drill string 26 forward while the guide 30 stays anchored at a fixed position.

Figure 2A:
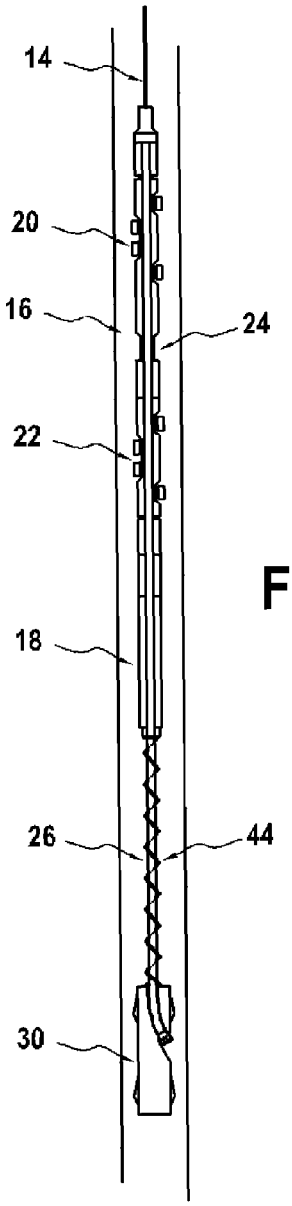
FIGS. 2*a* and 2*b* show a second embodiment of a drilling system according to the invention.
Figure 2B:
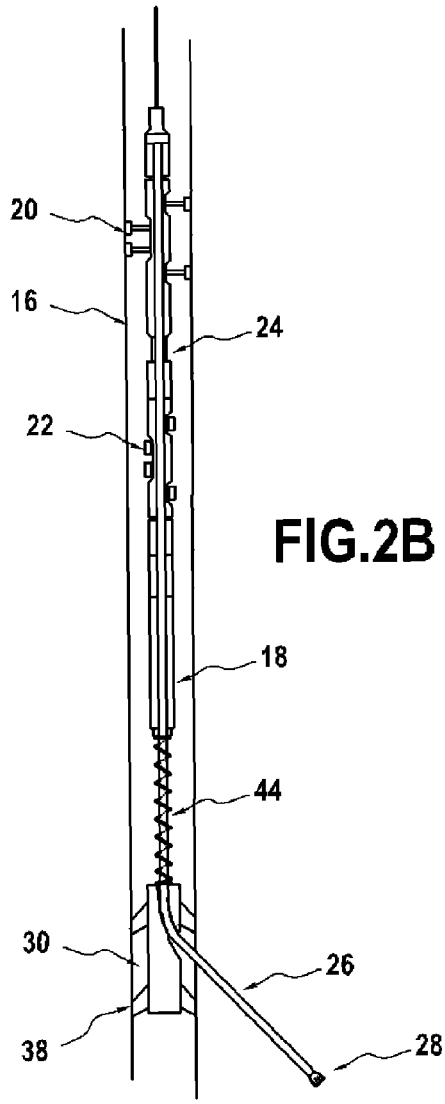

FIGS. 2*a* and 2*b* show corresponding views of a second embodiment of a system according to the invention. The same reference numerals are used as in FIGS. 1*a* and 1*b* for the same parts. The embodiment of FIGS. 2*a* and 2*b* differs from that of FIGS. 1*a* and 1*b* in that there is no telescopic support. In this embodiment, the drilling machine 10 supports the weight of the guide 30 using the drill string 26. This is achieved using a shaped seat 40 in the exit to the guide path 32 into which the drill bit seats (see FIG. 3), or by providing a contact ring 42 at the end of the drill string 26 adjacent the drill bit 28, the contact ring sitting in the seat 40 (see FIG. 4). The drill string 26 has a key formation 41 adjacent the drill bit 28 that sits in a recess 43 in the exit to the guide path 32 (see FIG. 5). The engagement of the key 41 in the recess 43 means that the drill string 26 cannot rotate relative to the guide 30. Therefore, rotation of the drill string 26 using the drilling motor 18 can be used to orient the exit of the guide path 32 in a predetermined direction. This will be the direction in which the lateral is drilled. (The key and recess formations are also found in the embodiment of FIGS. 1*a* and 1*b* for the same reason.)

A control line 44 extends between the drilling machine 10 and the guide 30 to provide power and control signals for anchoring and releasing the guide 30 in the main borehole 12. This can be an electric and/or hydraulic line and can also be applied in the embodiment of FIGS. 1*a* and 1*b*.

Figure 3:
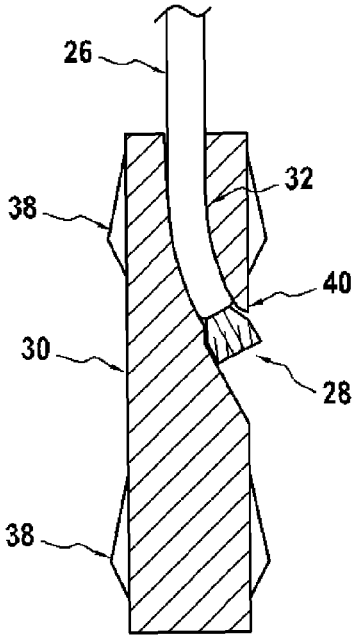
FIGS. 3-6 show various aspects of the guides of the embodiments of FIGS. 1*a* and 1*b*, and FIGS. 2*a* and 2*b;*
Figure 4:
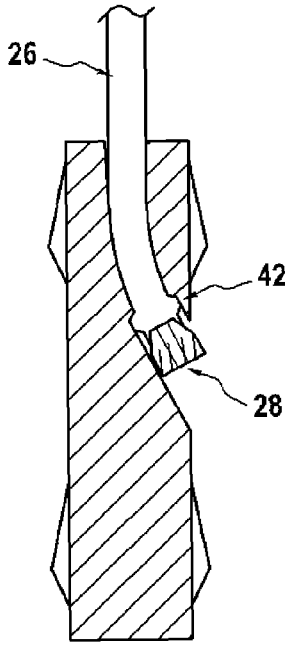
Figure 5:
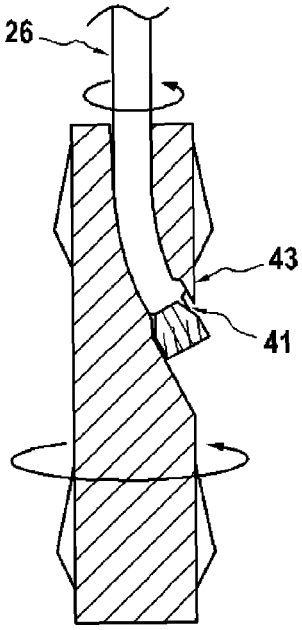
Figure 6:
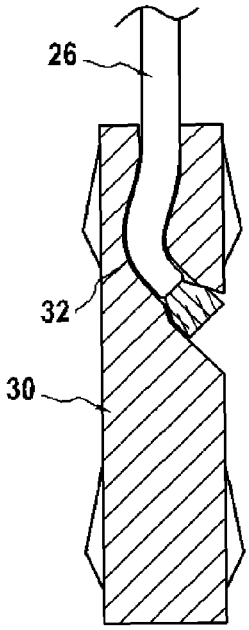

The guide path 32 in FIGS. 3-5 is shown as a simple curve between the upper part of the guide and the exit. However, it is also possible to provide the guide path as a more convoluted shape as is shown in FIG. 6 which may assist, for example in prevention of rotation of the guide or allow achieving a more aggressive exit angle (closer to ninety degrees).

Figure 7:
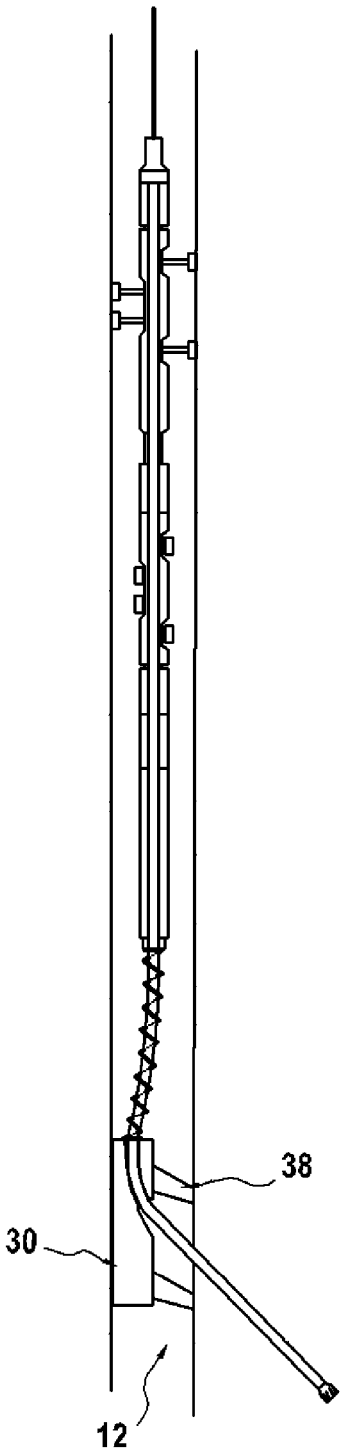
FIGS. 7 and 8 show variations on the embodiment of FIGS. 2*a* and 2*b;*
Figure 8:
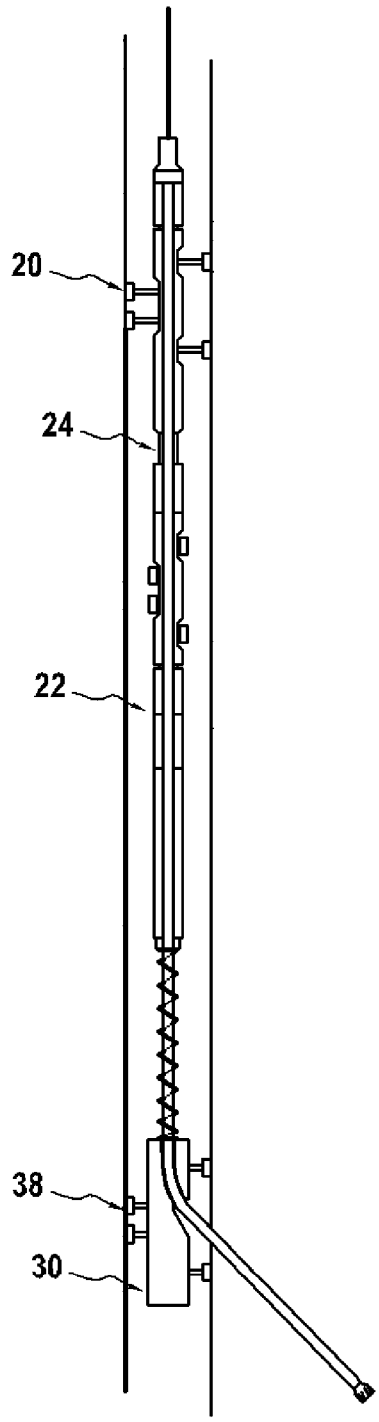

Various modifications can be made to the guide 30 within the scope of this invention. FIGS. 7 and 8 show two of these in relation to the type and position of the anchors 38. In FIG. 7, the anchors 38 are only disposed on one side of the guide 30 such that when they are deployed, they bear against the wall of the main borehole 12 and force the guide 30 against the opposite wall and secure it in place. In FIG. 8, the anchors 38 on the guide 30 are of the same form as the anchors 20, 22 of the drive section 24, i.e. pistons which extend radially from the body to engage the borehole wall.

Operation of the embodiment of FIGS. 2*a* and 2*b* will now be described in relation to FIGS. 9*a*-9*f*.

Figure 9A:
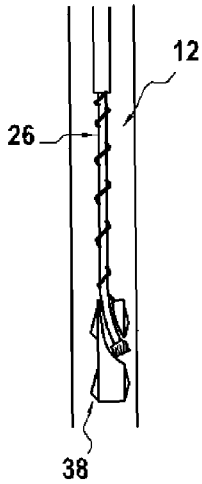
FIGS. 9*a-f* show various positions of the embodiment of FIGS. 2*a* and 2*b* in operation.
Figure 9B:
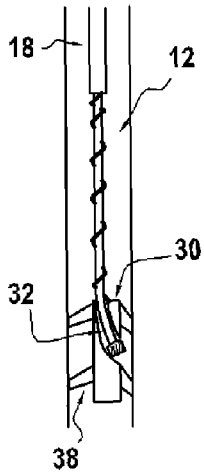
Figure 9C:
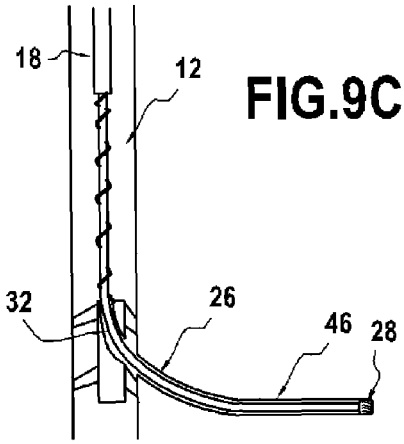
Figure 9D:
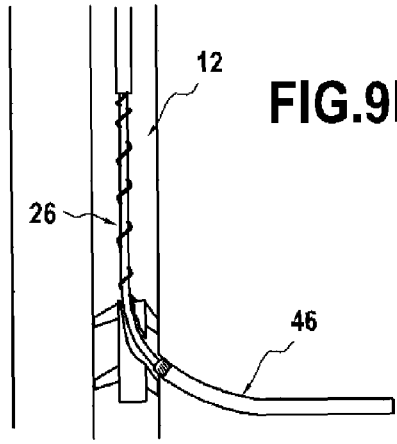
Figure 9E:
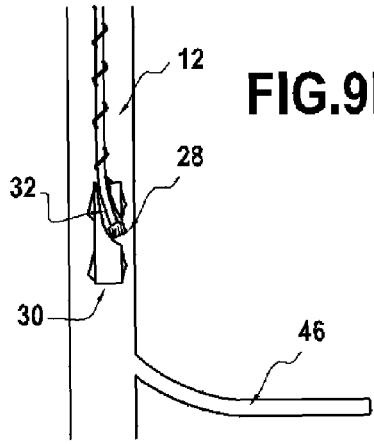
Figure 9F:
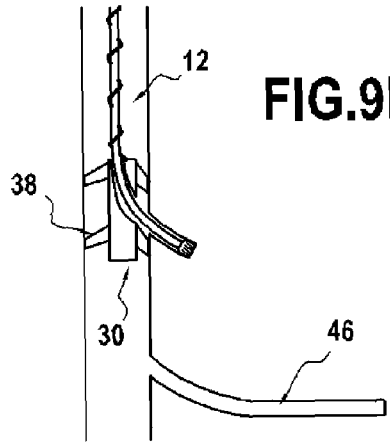

The drilling system is run into the main borehole 12 on a wireline cable with the guide anchors 38 in their closed position and the guide 30 carried on the drill string 26 (FIG. 9*a*). Once the desired depth is reached, the drilling motor 18 is operated to orient the guide 30 so that the exit of the guide path 32 is pointing in the desired direction for the lateral borehole to be drilled. The anchors 38 are then deployed into the second position to anchor the guide 30 in place (FIG. 9*b*). Then, the drill bit is slightly moved out of the guide so as to disengage the drill bit from the seat, for example so that the key is disengaged from the recess (FIG. 5) to enable the rotation of the bit. Drilling commences by rotating the drill bit 28 with the drilling motor 18 while applying axial force using the drilling tractor 16. The effect of the deviated guide path 32 is to force the flexible drill string 26 to drill laterally from the main borehole 12 (FIG. 9*c*). Once the lateral borehole 46 has been drilled to the desired depth (limited ultimately by the length of the drill string 26), drilling is stopped and the drilling machine 10 is withdrawn up the main borehole 12 to withdraw the drill string 26 from the lateral borehole 46 (FIG. 9*d*). Once the drill bit 28 is back in the guide 30, the anchors 38 can be released and the drilling system moved in the main borehole 12, the drill string 26 carrying the guide 30 (FIG. 9*e*). When it reaches a new location, the guide 30 can be oriented, the anchors 38 set and drilling can recommence (FIG. 9*f*). This process can be repeated several times in the borehole according to requirements without the need to withdrawn the drilling system from the main borehole 12.

Various modifications can be made to the system while remaining within the scope of the invention. The guide can also act as a store for equipment to be positioned in the lateral borehole. For example. sensors or well completion equipment can be stored in the guide and picked up by the drill string and inserted into the lateral borehole by the drill string.

Figure 10E:
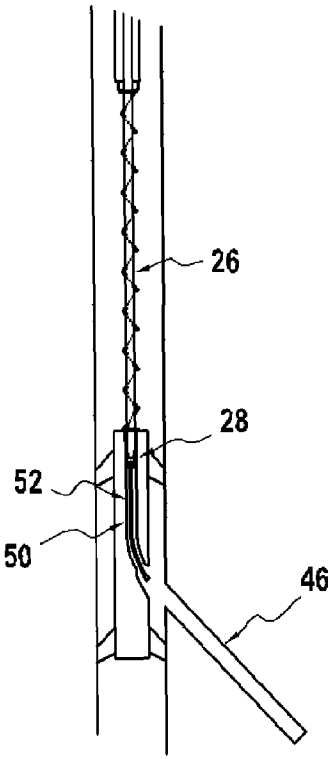
FIGS. 10*a-e* show a further embodiment of the invention.
Figure 10D:
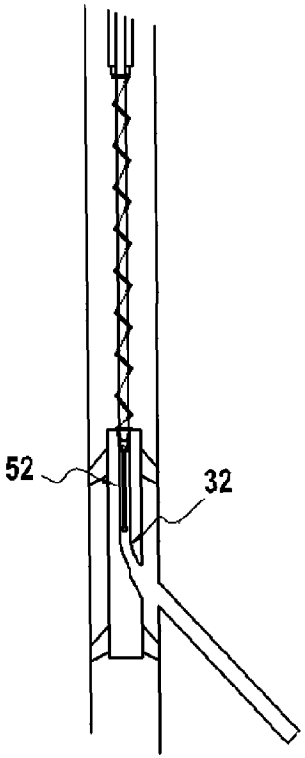
Figure 10C:
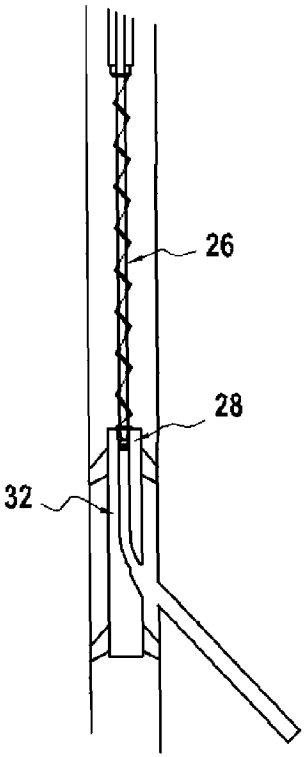
Figure 10B:
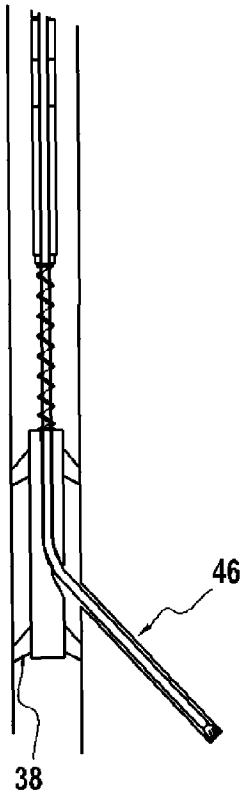
Figure 10A:
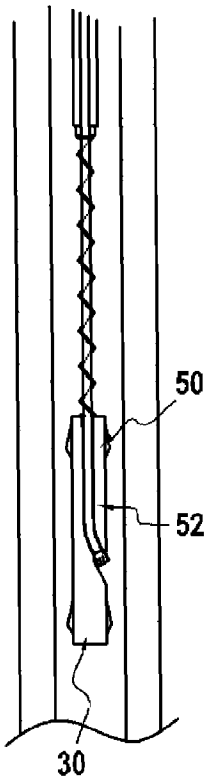

FIGS. 10*a*-*e* show an embodiment in which the guide has sensors for deployment in the lateral. In the embodiment of FIG. 10*a*-*e*, the guide 30 has receptacles 50 in which strings of sensors 52 are loaded at the surface. The drilling machine and guide are lowered into the well (FIG. 10*a*), the anchors 38 deployed and the lateral hole 46 drilled in the same manner as described above (FIG. 10*b*). Once the lateral has been drilled to target depth, the drill string 26 is withdrawn until the drill bit 28 near the top of the guide path 32 (FIG. 10*c*). A string of sensors 52 is then deployed into the guide path 32 below the drill bit 28 (FIG. 10*d*) and the drill string 26 is once again advanced so that the drill bit 28 pushes the sensor string 52 through the guide 30 and into the lateral 46 (FIG. 10*e*). Once the sensor string 52 is in place in the lateral 46, the drill string can again be withdrawn and the drilling machine and guide moved to another location for drilling a lateral and placing a sensor string. This can be repeated until the receptacles 50 are emptied. The sensors can be any type of sensor suitable for deployment in underground boreholes, for example pressure or temperature sensors, or sensors monitoring chemical or electrical properties or acoustic signals.

Figure 11A:
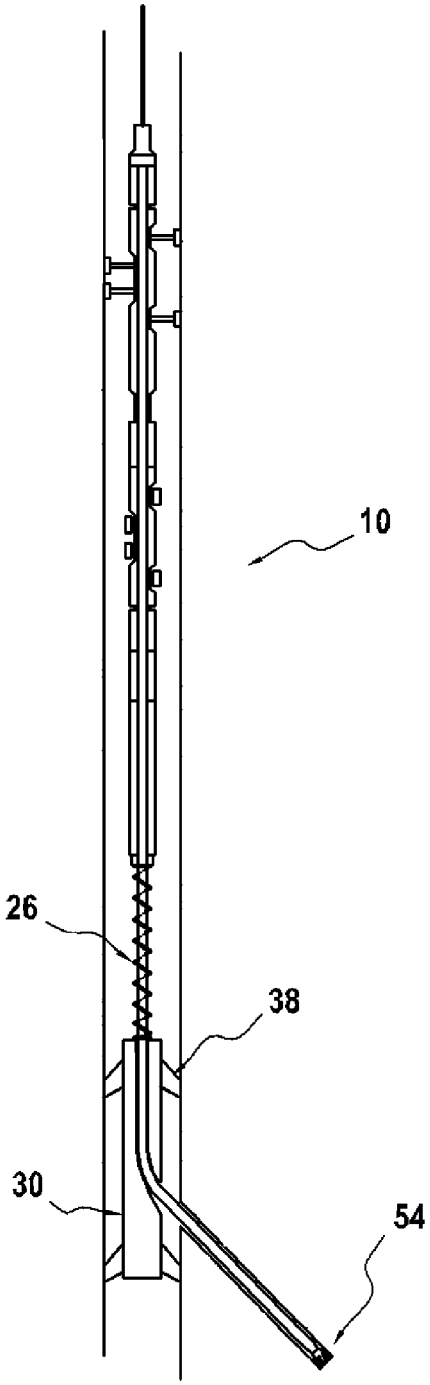
FIGS. 11*a* and 11*b* show a further embodiment of the invention used for coring applications.
Figure 11B:
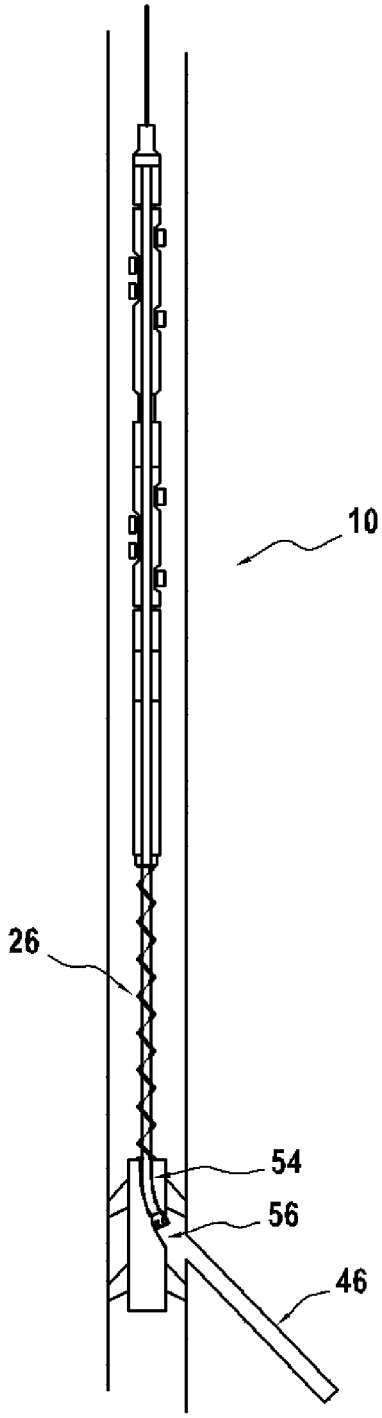

FIGS. 11*a*-*b* show an embodiment in which the drill string is equipped with a coring bit 54. The drilling machine 10 and guide 30 are lowered into the well, the anchors 38 are deployed and the lateral hole 46 is drilled so that the formation rock is stored inside the drill pipe 26. Once the core 56 has been taken, the drill string 26 is withdrawn and the drilling machine 10, drill string 26, and guide 30 are pulled back to surface.

Further modifications can be made while staying within the scope of the invention.

A drilling system, comprising: a drilling machine; a drill string connected at one end to the drilling machine so as to be driveable in an axial direction; and a guide connected to the drilling machine such that when the drill string is driven axially by the drilling machine, it interacts with the guide so as to be directed in a predetermined radial direction; wherein the drill string is permanently engaged so as to be slideable in the guide. A method of drilling a lateral borehole from a main borehole, comprises: positioning a drilling system as claimed in any preceding claim in the main borehole; anchoring the guide in the borehole adjacent the location at which the lateral borehole is to be drilled; operating the drilling machine to drive the drill string in an axial direction; and deflecting the drill string, by means of the guide, in a radial direction into the wall of the main borehole to drill the lateral borehole.

The invention claimed is:

1. A drilling system, comprising:

a drilling machine;

a drill string connected at one end to the drilling machine so as to be driveable in an axial direction; and a guide connected to the drilling machine such that when the drill string is driven axially by the drilling machine, the drill string interacts with the guide so as to be directed in a predetermined radial direction;

wherein the guide is rotatable by the drilling string and fixed relative to the drilling machine in the axial direction;

wherein the drill string is permanently engaged so as to be slideable in the guide;

wherein the drilling machine includes a drilling tractor for moving the drill string in the axial direction, and anchors operable to engage a main borehole and provide a reaction to axial and rotation forces; and wherein the guide comprises anchor arms mounted thereon and movable between a first position close to the guide and a second position in which they engage the main borehole wall to anchor the guide in place whereby the drilling machine can push the drill string forward while the guide stays anchored at a fixed position; the anchor arms of the guide being separate from the anchors of the drilling machine so as to allow the guide to be anchored after the drilling string is directed in the predetermined radial direction while the drilling machine is anchored in the main borehole by the anchors.

2. A drilling system as claimed in claim 1, wherein the guide is coaxial with the drilling machine.

3. A drilling system as claimed in claim 1, wherein the guide defines a guide path that is substantially central to the guide at a point nearest the drilling machine and exits from a side part of the guide further away from the drilling machine, the drill string being slideably engaged in the guide path.

4. A drilling system as claimed in claim 1, wherein the guide is axially offset from the drilling machine.

5. A drilling system as claimed in claim 1, wherein the guide defines a guide path that is offset from a center of the guide at a point nearest the drilling machine and exits from a side part of the guide further away from the drilling machine, the drill string being slideably engaged in the guide path.

6. A drilling system as claimed in claim 1, wherein the drill string is rotatable by the drilling machine.

7. A drilling system as claimed in claim 1, wherein the drill string transmits rotation to the guide so as to adjust the predetermined radial direction.

8. A drilling system as claimed in claim 1, wherein the drill string carries a drill bit at another end remote from the drilling machine.

9. A drilling system as claimed in claim 8, wherein the guide includes a seat into which the drill bit or a contact ring on the drill string near the drill bit can locate.

10. A drilling system as claimed in claim 9, wherein the seat and the drill bit or the contact ring include inter-engaging formations to prevent relative rotation of the guide and the drill string when the bit or the contact ring is engaged in the seat.

11. A drilling system as claimed in claim 1, further comprising a telescopic link extending between the drilling machine and the guide.

12. A drilling system as claimed in claim 1, further comprising a control line extending between the drilling machine and the guide.

13. A drilling system as claimed in claim 1, wherein the drilling machine is supported by a flexible conveyance means.

14. A drilling system as claimed in claim 1, wherein the guide further comprises one or more receptacles for sensors which can be deployed into the lateral borehole drilled by the drilling system.

15. A method of drilling a lateral borehole from a main borehole, comprising:

positioning a drilling system in the main borehole, the drilling system comprising:

a drilling machine including anchors;

a drill string connected at one end to the drilling machine so as to be driveable in an axial direction; and a guide connected to the drilling machine such that when the drill string is driven axially by the drilling machine, the drill string interacts with the guide so as to be directed in a predetermined radial direction; the guide being rotatable by the drilling string and fixed relative to the drilling machine in the axial direction; and wherein the guide comprises anchor arms mounted thereon and movable between a first position close to the guide and a second position in which they engage the main borehole wall to anchor the guide in place whereby the drilling machine can push the drill string forward while the guide stays anchored at a fixed position; the anchor arms being different from the anchors of the drilling machine;

anchoring the drilling system with the anchors in the main borehole;

orienting an exit of a guide path in the guide in the predetermined radial direction;

anchoring the guide with the anchor arms in the main borehole adjacent the location at which the lateral borehole is to be drilled;

operating the drilling machine to drive the drill string in the axial direction; and deflecting the drill string, by means of the guide, in the predetermined radial direction into the wall of the main borehole to drill the lateral borehole.

16. A method as claimed in claim 15, further comprising, prior to anchoring the guide, rotating the drill string with the drilling machine to rotate the guide so as to orient the exit to deflect the drill string in the predetermined radial direction.

17. A method as claimed in claim 15, further comprising, after drilling the lateral borehole, releasing the anchor arms of the guide, moving the drilling system to a new position in the main borehole and repeating the anchoring, orienting, anchoring, operating and deflecting steps to drill a further lateral borehole.

18. A method as claimed in claim 17, comprising supporting the guide on the drill string during the step of positioning or moving the drilling system in the main borehole.

19. A method as claimed in claim 17, comprising supporting the guide on a separate support during the step of positioning or moving the drilling system in the main borehole.

20. A method as claimed in claim 15, wherein the guide contains one or more sensors, the method comprising: following drilling the lateral borehole, withdrawing the drill string from the borehole, positioning the sensor in the guide below the another end of the drill string, and advancing the drill string to force the sensor into the lateral borehole.

21. A method as claimed in claim 15, wherein the drill string is equipped with a coring bit and can be used to store a core.

* * * * *